United States Patent [19]

Maloney et al.

[11] 3,960,379

[45] June 1, 1976

[54] CHILDREN'S GAME

[76] Inventors: Joseph V. Maloney, 3381 Lufberry Ave., Wantagh, N.Y. 11793; Ronald J. Geigel, 4 Alpine Drive, Morristown, N.J. 07960; Peter R. Zidek, Horseshoe Road, Rte. 2, Box 87, Millbrook, N.Y. 12545

[22] Filed: Feb. 24, 1975

[21] Appl. No.: 552,693

[52] U.S. Cl. ..... 273/95 R; 273/102.1 B; 340/280

[51] Int. Cl.[2] ..... A63B 71/00; G08B 21/00

[58] Field of Search ..... 273/95 R, 101, 102 R, 273/102.1 R, 102.1 B, 102.1 C, 102.2 R, 102.2 A, 1 R, 1 E, 52, 127 R, 184 R, 185 R; 116/77, 79, 99; 340/323,280

[56] References Cited

UNITED STATES PATENTS

| | | | |
|---|---|---|---|
| 3,164,383 | 1/1965 | Roop | 273/52 |
| 3,636,547 | 1/1972 | Brace | 340/280 |
| 3,685,037 | 8/1972 | Bennett | 340/280 |
| 3,761,087 | 9/1973 | Meyer | 273/95 R |

*Primary Examiner*—Richard C. Pinkham
*Assistant Examiner*—Marvin Siskind
*Attorney, Agent, or Firm*—James J. Burke

[57] ABSTRACT

A game of "kick the can" comprises a kickable object including a magnet, and a base on which the object rests including a normally closed magnetic switch openable by the magnet, and a battery operated buzzer in circuit with the switch.

6 Claims, 3 Drawing Figures

FIG. 1
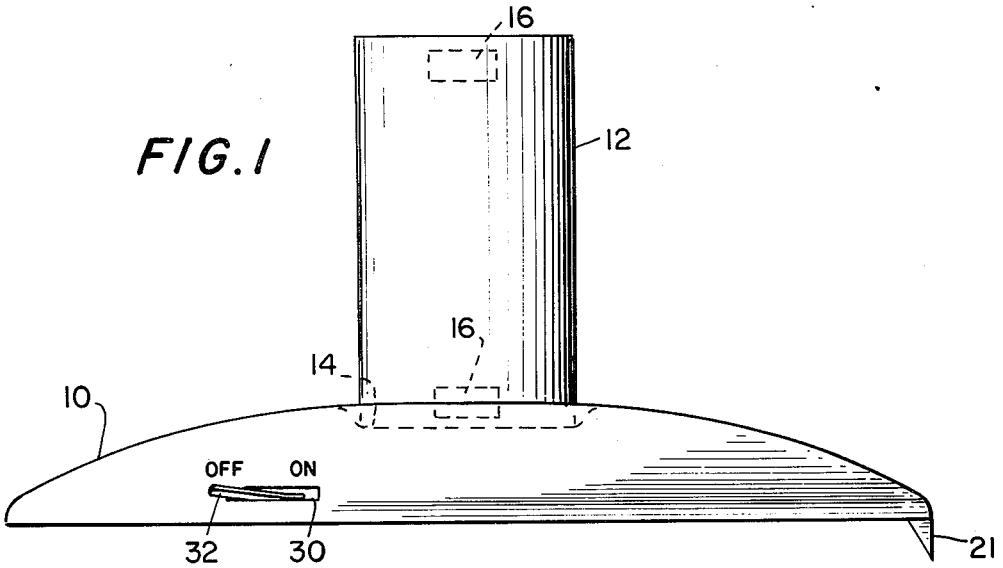
FIG. 2
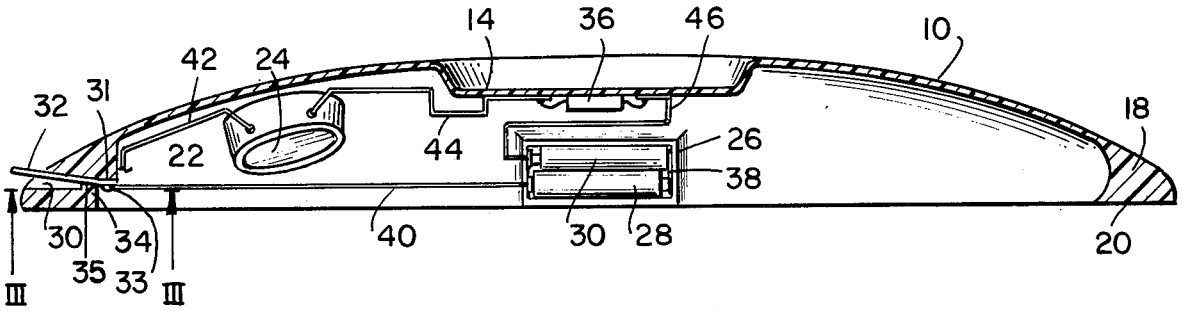
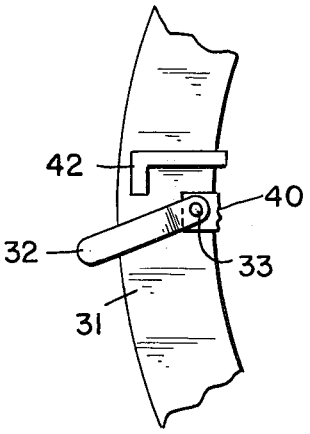
FIG. 3

CHILDREN'S GAME

The present invention relates to children's games and, more particularly, the venerable game of "kick the can".

In "kick the can ", the can is placed at "home plate" and one player then kicks it off "home plate" as far as he or she can. The player who is "it" must then retrieve the can and return it to "home plate" while the other players hide. "It" then seeks to discover the hiding place of one or more of the other players, and upon so doing, loudly identifies the discovered player while simultaneously kicking the can off "home plate". The identified player at this point becomes "it", and must retrieve the can, starting the cycle again. An object of the game is to keep a player "it" for an extended period by kicking the can while "it" is engaged in stalking the hidden players. The game is both lively and suspenseful as the players try to outwit each other. To add a dimension of ritual, the player retrieving the can is usually required to run backwards to "home plate" and count aloud before announcing, "Here I come, ready or not." Obviously, many variations are possible.

It is an object of the present invention to provide an improved version of "kick the can", one that adds the excitement of an audible signal when the can is kicked, which only ceases when the can is returned "home".

Understanding of the invention will be facilitated by referring to the following description of a preferred embodiment and to the accompanying drawings, wherein:

FIG. 1 is an elevation view of an embodiment of the invention;

FIG. 2 is a cross-sectional elevation of the base shown in FIG. 1; and

FIG. 3 is a partial plan view taken along line III—III of FIG. 2.

With reference to FIG. 1, the invention comprises a base 10 and a kickable object 12 (hereafter "the can"). Base 10 should have a low profile so as not to impede the kicking of the can 12, but can be of any convenient shape. In the illustrated embodiment base 10 is circular with gently sloping sides, in the same general shape as the popular "Frisbee" toy, but with a circular depression 14 in the top where can 12 rests. The base 10 is described in detail hereinbelow with reference to FIG. 2.

The can 12 may be just that, e.g. a No. 10 can, but is preferably a tough molded plastic closed container or solid shape. Alternatively, it could be an eccentrically weighted shape or ball so that the path of flight will be irregular. In one or both ends, however, it should contain a small magnet 16, preferably buried just beneath the surface.

FIG. 2 shows the base 10 in cross-section and attention is directed thereto. In the preferred embodiment, the base 10 is one piece of molded plastic, having a thickened edge portion 18 with a ground-engaging bottom surface 20. Surface 20 is preferably a high-friction surface, so that base 10 will remain stationary when can 12 is kicked. If the game is to be played on dirt or grass, surface 20 may be provided with spikes 21 or other protrusions. Molded on the underside of base 10 is a first circular enclosure 22 adapted to frictionally engage a buzzer 24 or other audible signal producing device. Also molded on the underside of base 10 is a second rectangular enclosure 26 adapted to frictionally engage a pair of penlight batteries 28, 30 or whatever battery is required to power buzzer 24.

A slot 30 is provided on one side of base 10 to accomodate a simple on-off switch arm 32. More particularly, slot 30 is in edge portion 18, and on its upper surface 31 arm 32 is pivotally mounted (FIG. 3). Directly below arm 32 edge portion 18 is cut away to edge 34 to facilitate assembly. Base 10 is completed with a normally closed magnetic switch 36 centrally mounted on the bottom surface of depression 14, and necessary wiring.

Electrical connection of base 10 is accomplished by connecting batteries 28, 30 and buzzer 24 in a simple circuit including manual switch 32 and magnetic switch 36. While such wiring may be done in a variety of ways, for high-volume, low cost production it is preferred that it be "printed" directly into the undersurface of base 10 by electroless plating, vacuum evaporation or any of the well-established techniques used in the manufacture of printed circuits on plastic substrates. This has the added advantage of eliminating additional metal parts which would be required as contacts with the various elements.

More particularly, battery enclosure 26 has metal 38 printed across one end so the batteries will be series connected, and a pair of contacts at the other end. One of the latter is integral with conductor 40 which terminates on surface 31. Another conductor 42 starts on surface 31 and extends to one side of buzzer 24, still another conductor 44 connects buzzer 24 with one side of switch 36, and a last conductor completes the circuit back to the other battery contact. It will be appreciated that conductive, adhesive-backed tape could also be used for the wiring.

Operation of switch arm 32 is seen in FIG. 3. Conductor 40 terminates on surface 31 below the pivot of arm 32, provided by a rivet 33 or the like, and is always in electrical contact therewith. Arm 32 contacts conductor 42, however, only when it is moved to the "on" position. Slot 30 should be dimensioned so as to maintain arm 32 in wiping contact with the conductors or, alternatively, cut-out edge 34 may be provided with an upper, up-standing rim or protrusion 35 to accomplish the same function. Obviously, other manually operable switch means could be employed.

Assembly of the preferred embodiment requires a minimum of hand labor. Arm 32 is riveted to surface 31 with rivet 33, and switch 36 is soldered or otherwise fastened to conductors 44 and 46. Then, it is merely necessary that buzzer 24 and batteries 28, 30 be inserted in proper orientation in their respective enclosures, operations which may be performed by the purchaser.

Operation of the invention is simple and obvious. When switch 32 is "on", buzzer 24 will sound unless can 12 is in depression 14, in which event magnets 16 will hold switch 36 in the open position. When can 12 is kicked, buzzer 24 will sound until can 12 is replaced. It will be appreciated that mechanical switch means could be substituted for the magnet-magnetic switch combination.

Various changes in the details, steps, materials and arrangements of parts, which have been herein described and illustrated in order to explain the nature of the invention, may be made by those skilled in the art within the principle and scope of the invention as defined in the appended claims.

We claim:

1. A game comprising, in combination:
a base; and
a kickable object;
said base comprising:
ground-gripping means;
an enclosure having a depression for receiving said kickable object on its upper surface;
said base containing interior thereof battery means, first and second switch means, audible signal producing means and circuitry means capable of connecting said signal means across said battery means for the generation of an audible signal upon closure of both said first and second switch means;
said first switch means being manually closeable; and
magnet means positioned within said kickable object so as to be adjacent said depression, said second switch means being adjacent said depression and magnetically held in the open position by said magnet means when said object is placed in said depression.

2. The game as claimed in claim 1, wherein said ground-gripping means comprises a high-friction bottom surface on said base.

3. A game comprising, in combination:
a base; and
a kickable object;
said base comprising:
an enclosure having a depression for receiving said kickable object on its upper surface, and downwardly-extending, ground-engaging spikes;
said base containing interior thereof battery means, first and second switch means, audible signal producing means and circuitry means capable of connecting said signal means across said battery means for the generation of an audible signal upon closure of both said first and second switch means;
said first switch being manually closeable;

and said second switch means being adjacent said depression and closed by removal of said object from said depression.

4. A game comprising, in combination:
a base; and
an eccentrically-weighted ball
said base comprising:
ground-gripping means;
an enclosure having a depression for receiving said ball on its upper surface;
said base containing interior thereof battery means, first and second switch means, audible signal producing means and circuitry means capable of connecting said signal means across said battery means for the generation of an audible signal upon closure of both said first and second switch means;
said first switch means being manually closeable;
and said second switch means being adjacent said depression and closed by removal of said ball from said depression.

5. The game as claimed in claim 4, wherein said ball has sufficient weight to hold said second switch means in the open position when in said depression.

6. A game comprising, in combination:
a base; and
a kickable object;
said base comprising:
ground-gripping means;
an enclosure having a depression for receiving said kickable object on its upper surface;
said base containing interior thereof battery means, first and second switch means and audible signal producing means mounted on and connected by printed circuitry on the bottom side of the upper surface of said base, and capable of connecting said signal means across said battery means for the generation of an audible signal upon closure of both said first and second switch means;
said first switch means being manually closeable;
and said second switch means being adjacent said depression and closed by removal of said object from said depression.

* * * * *